United States Patent [19]

Novak

[11] 4,196,575

[45] Apr. 8, 1980

[54] METHOD FOR TRANSFER OF A FIBER ROVING FROM A COMPLETED BOBBIN PACKAGE TO AN EMPTY TUBE ON A SPINNING PREPARATORY MACHINE

[75] Inventor: Peter Novak, Winterthur, Switzerland

[73] Assignee: Rieter Machine Works, Ltd., Winterthur, Switzerland

[21] Appl. No.: 946,655

[22] Filed: Sep. 28, 1978

[30] Foreign Application Priority Data

Oct. 4, 1977 [CH] Switzerland ..... 12089/77

[51] Int. Cl.[2] ..... D01H 9/02; D01H 1/40; D01H 7/24

[52] U.S. Cl. ..... 57/267; 57/71; 57/131; 57/299

[58] Field of Search ..... 57/67, 70, 71, 96, 129–132, 57/102, 117, 267, 273, 299, 303

[56] References Cited

U.S. PATENT DOCUMENTS

| | | | |
|---|---|---|---|
| 350,782 | 10/1886 | Smith | 57/117 |
| 578,811 | 3/1897 | Burr | 57/131 |
| 2,581,012 | 1/1952 | Garnett | 57/278 |
| 3,186,154 | 6/1965 | Negishi | 57/278 |
| 3,380,238 | 4/1968 | Araki et al. | 57/267 |
| 3,403,502 | 10/1968 | Caminada | 57/129 |
| 3,472,013 | 10/1969 | Grishin et al. | 57/117 X |
| 3,491,526 | 1/1976 | Krauss et al. | 57/131 |
| 3,643,415 | 2/1972 | Mackie | 57/117 |
| 3,681,905 | 8/1972 | Furtmeier et al. | 57/299 |
| 4,015,416 | 4/1977 | Mori et al. | 57/67 X |

*Primary Examiner*—John Petrakes
*Attorney, Agent, or Firm*—Kenyon & Kenyon

[57] ABSTRACT

Prior to doffing a bobbin package, the roving is severed to form a beard which is located adjacent a stop on the spindle. After the bobbin package is doffed, the beard is located adjacent to an axial stop on the spindle. When a fresh tube is donned, the roving beard is brushed down by the tube and clamped by the bottom of the tube against the axial stop. A new package can then be wound while the roving beard remains clamped.

10 Claims, 20 Drawing Figures

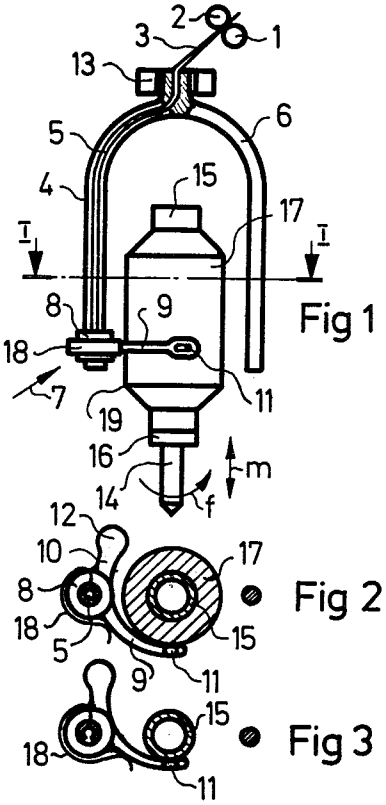
Fig 1
Fig 2
Fig 3
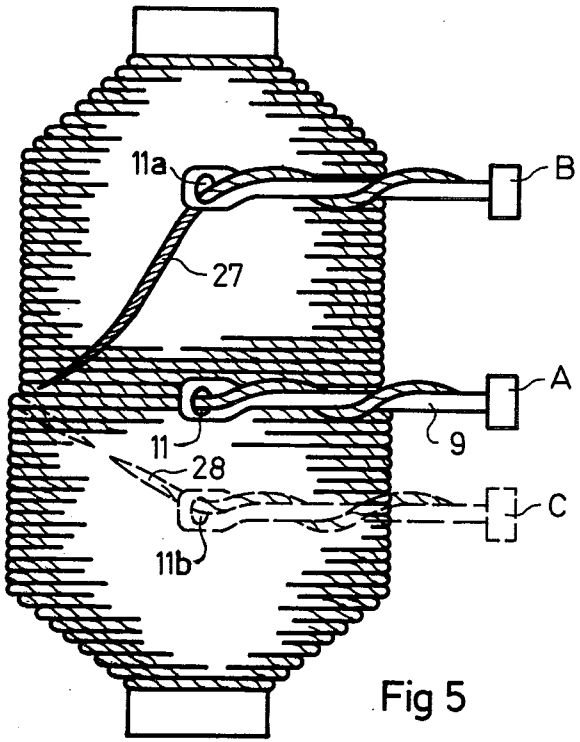
Fig 5

METHOD FOR TRANSFER OF A FIBER ROVING FROM A COMPLETED BOBBIN PACKAGE TO AN EMPTY TUBE ON A SPINNING PREPARATORY MACHINE

This invention relates to a method and apparatus for the transfer of a fiber roving from a completed bobbin package to an empty tube on a spinning preparatory machine equipped with a flyer and with a winding device.

As is known, upon completion of a bobbin package build at a spinning position of a spinning preparatory machine employing a flyer with a winding device (also called roving frame, slubber or fly frame), the spinning position is generally stopped in such a manner that the winding device of the flyer is located approximately at mid-height of the bobbin package. The flyer is then lifted and the roving is severed between the winding device and the bobbin package. Upon taking off the completed bobbin, an empty bobbin tube is placed onto the spindle. If the flyers are supported at their heads, severing of the roving can be effected automatically by lowering a bobbin rail. In this case, the completed bobbin packages are doffed and empty bobbin tubes are donned. However, the end of the severed fiber roving, danglng from the winding device and forming a fiber roving beard, must be placed onto the empty bobbin tube before the roving frame can be re-started so that the fiber roving can be wound onto the bobbin tube. This transfer of the fiber roving is effected manually either by pasting the beard to the tube using a wet sponge or by supplying a certain length of fiber roving, which is pulled manually through the flyer and wound in several windings around the bobbin tube, until the roving is held and secured thereon.

Due to this complicated and time consuming transfer of the fiber roving during the bobbin change, an automatic bobbin change process is not possible. As a result, the efforts heretofore made for automating the roving frame thus far have yielded little success.

It has also been known, for example, as described in Swiss Pat. No. 442,090 and British Pat. No. 1,085,435 to transfer a severed roving beard dangling from a winding device to the new empty tube by placing the winding device and roving beard in contact with a zone of the tube on which an adhesive is placed so that the roving beard adheres to the adhesive surface and is carried on as the roving frame is started up. This method, however, has the disadvantage that rests of the roving clinging to the adhesive surface must be eliminated laboriously before the tube can be reused again. This method is thus not waste-free.

It has also been known from U.S. Pat. No. 3,681,905 and German DAS No. 1,801,978, to form reserve windings upon completion of a bobbin package on an auxiliary winding surface which is arranged separately above the upper bobbin tube end. As the completed bobbin package is doffed, the fiber roving is severed between the bobbin and the reserve windings. The reserve windings, and thus the spindle, and the winding device remain connected. Upon donning the empty bobbin tube, winding of the roving onto the spindle can be resumed without additional processes. In order to effect an automatic elimination of the reserve windings, these reserve windings are shifted onto the bobbin tube as soon as the first layer of fiber roving is wound onto the tube. For this purpose, the auxiliary winding surface for taking up the reserve windings is arranged to be slidable along the spindle shaft. This method, however, presents the disadvantage, that the reserve windings which are shifted onto the tube rotate freely in the room with their loose end in such a manner that the fiber roving gradually dissolves into fly waste. Furthermore, this method requires a sliding shift of the reserve windings which is to be effected not while the tube is being donned but during the regular bobbin package building process. The shifting element must thus be axially movable during the operation of the roving producing unit. The construction of the roving frame is thus expensive and requires careful maintenance.

Accordingly, it is an object of the invention to provide for a waste-free operation in the doffing and donning of bobbin tubes on a spindle of a spinning preparatory machine.

It is another object of the invention to eliminate any fiber roving rests on a spindle or bobbin tube in a flyer winding arrangement.

It is another object of the invention to secure the front end of a fiber roving in a bobbin exchange operation in such a manner that the roving end cannot dissolve into fly waste.

It is another object of the invention to provide an apparatus for exchanging bobbins which is simple and reliable in operation.

Briefly, the invention provides a method and apparatus for transferring a fiber roving from a completed bobbin package on a spindle to an empty tube on a spinning preparatory machine.

In accordance with the method, the spindle supporting the bobbin package and a flyer coaxial of the spindle are stopped in a position with a winding device on the flyer located within the winding lift of the last winding of the roving on the bobbin package. Next, the roving is severed between the completed bobbin package and the winding device to form a roving beard which protrudes from the winding device. Thereafter, the winding device is displaced relative to the bobbin package into an end position with the roving beard located in the immediate vicinity of the bottom part of the bobbin tube of the bobbin package. The bobbin package is then doffed from the spindle in a vertical direction and an empty tube is donned onto the spindle in a vertical direction while brushing the roving beard downwardly to clamp the beard between the tube and spindle.

Severing of the roving is effected by unrolling the roving on the bobbin package surface. This can be effected by a vertical shifting movement of the bobbin package with respect to the winding device.

The apparatus of the invention includes a rotatable spindle for receiving a tube for winding of a bobbin package thereon, a rotatable flyer coaxial of the spindle, a winding device supported on the flyer and having an exit opening for a roving, an axial stop on the spindle for taking up a bobbin tube and pressing means for pressing the winding device radially towards the spindle with the flyer at a standstill.

The apparatus for implementing the method with a rotating spindle supporting the bobbin tube and with a flyer, which is rotatable coaxially with the spindle and which supports a winding device, is characterised in that:

(a) Pressing means are provided, pressing the winding device containing an exit opening for the roving radially against the spindle while the flyer is at a standstill.

(b) A lower axial stop is provided on the spindle for taking up the bobbin tube.

(c) The winding device containing the exit opening is displaceable toward the outside by the tube donning movement shortly before the tube reaches the stop.

The pressing means may contain a spring for biasing the winding device towards a bobbin on the spindle by pivoting the device about a pivot axis toward the bobbin.

In one embodiment, the winding device is provided with a plate to define the exit opening. This plate can be flat and may be inclined relative to a longitudinal axis of the spindle or may be parallel to the spindle axis to cooperate with a bobbin tube having a tapered bottom edge. The plate can also be curved in an upwardly directed vertical direction. The plate cooperates with a doffed bottom tube so that the tube pushes the plate and, thus, the winding device away from the spindle as a roving beard is clamped in place.

The apparatus may also include at least one presser member in the spindle for engaging a tube on the spindle under an outwardly directed radial force to secure the tube to the spindle. The presser member may also secure the tube axially of the spindle.

The axial stop on the spindle may be formed by an annular ring which is resiliently supported coaxially of the spindle to receive a tube. This stop can be pressed down by the bobbin tube secured to the spindle and may also have a surface of high friction contacting the tube. Still further the tube may have a conically tapered bottom to cooperate with a similar surface on the ring.

These and other objects and advantages of the invention will become more apparent from the following detailed description and appended claims taken in conjunction with the accompanying drawings in which:

FIG. 1 illustrates a schematic view of an apparatus according to the invention;

FIG. 2 illlustrates a view taken on line I—I of FIG. 1 with a completed bobbin package;

FIG. 3 illustrates a view similar to FIG. 2, but with an empty bobbin tube;

FIGS. 4*a* to 4*g* illustrate various positions of the apparatus of FIG. 1 during a bobbin transfer operation;

FIG. 5 illustrates a schematic detail of two steps for severing a roving in accordance with the invention.

FIGS. 6*a* to 6*c* illustrate various positions of a spindle and a fresh bobbin during a donning operation of the invention;

FIGS. 7*a* to 7*c* illustrate various positions of a modified bobbin tube and winding device during a donning operation of the invention;

Figure 4A:
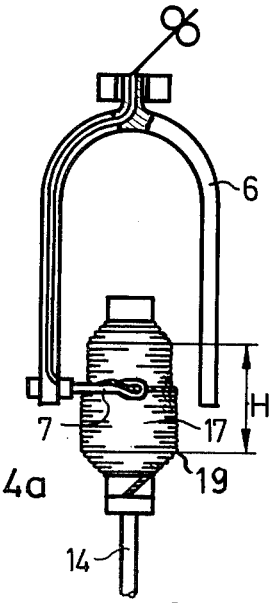

Referring to FIG. 1, a drafting arrangement of a roving frame including a pair of delivery rolls 1, 2 supplies a fiber roving 3 to a spinning prepatory machine in order to impart twist to the roving 3 for further processing.

For this purpose, the fiber roving 3 is guided via a fiber guide duct 5 formed by a hollow arm 4 (see also FIG. 2) of a rotating flyer 6. The hollow arm 4 supports a winding device (also called presser finger), at the lower end. This winding device consists of a sleeve 8 rotatably supported about the hollow arm 4 (FIGS. 1 and 2), and two extensions 9, 10 (FIG. 2) which are connected to the sleeve 8 in diametrically opposed relation. The extension 9 is provided at the free end with an exit opening 11 for the fiber roving 3, whereas the second extension 10 is shaped as a counterweight 12.

The flyer 6 is constructed as a suspended flyer supported at the head part. In this arrangement, the flyer 6 is suspended in a vertical disposition at an upper portion in a bearing 13, which is connected to the machine frame (not shown), and is set into rotation using a suitable drive means (not shown) e.g. gear arrangements or toothed belts.

Furthermore, the working position of the roving frame contains a spindle 14 onto which a detachable tube 15 is placed. The spindle 14 is provided with a stop 16 for the tube 15, which stop 16, as shown in FIG. 1, is of the shape of a large ring rigidly connected to the spindle 14. The fiber roving 3 is wound onto the tube 15 in the form of a bobbin package 17.

During operation, the fiber roving 3 is guided via the fiber guide duct 5 and wrapped in a number of windings around the extension 9 at the lower end of the duct 5 (FIG. 5), and subsequently is guided through the exit opening 11. This arrangement of the extension 9 and the exit opening 11 is used for precisely supplying the fiber roving 3 onto the surface of the bobbin package 17, in such a manner that windings as compact and parallel as possible can be formed thereon. In order to build the bobbin package 17, the spindle rotates at a precisely determined speed (arrow f of FIG. 1) and is subject to a vertical up and down traversing movement of variable lift (arrow m of FIG. 1).

The ratios of rotational speeds of the flyer 6 and of the spindle 14 follow a precisely determined function, the detailed description of which is dispensed with in this context.

As the flyer 6 rotates, the exit opening 11 of the winding device 7 is always pressed against the surface of the bobbin package 17 due to the centrifugal force acting on the counterweight 12. This force, however, is absent when the flyer 6 is at a standstill.

The winding device 7 is also provided with a pressing means, for pressing the winding device 7 and, thus the exit opening 11 of the winding device 7 radially towards the spindle at all times, i.e. also while the flyer 6 is at a standstill. As shown in FIGS. 1 through 3, the pressing means is in the form of a flat spring 18, one end of which is rigidly clamped in the hollow arm 4 and the other end of which presses against the extension 9. As shown in FIG. 2, the position of the exit opening 11 on an almost completed bobbin package 17 is discernible, i.e. practically at the end of the package winding operation, whereas in FIG. 3 the position of the exit opening 11 on an empty bobbin tube 15 is known, i.e. practically at the beginning of the package winding operation.

The pressing means may also be constructed in other forms e.g. a torsion spring can be very suitable.

Figure 4B:
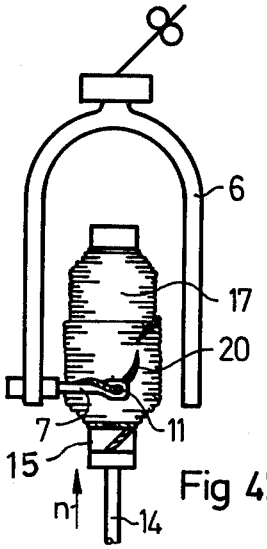
Figure 4C:
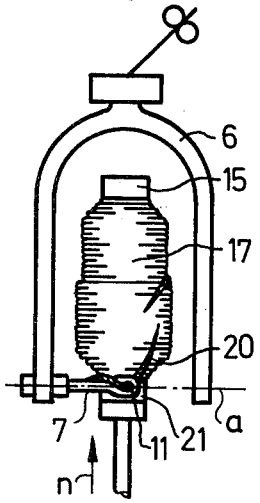

In order to carry out a fiber roving transfer operation i.e. when the bobbin package 17 has reached full diameter (FIG. 4*a*), the spindle 14 and flyer 6 are stopped in a position in which the winding element 7 is located within the winding traverse H (FIG. 4*a*) of the last winding layer. Next, the flyer 6, or the exit opening 11 respectively, are moved along the cylindrical surface of the bobbin package 17 to the point 19 (FIG. 1) of the bobbin package 17 where the bobbin package 17 tapers off downwardly. From this point 19 downward, the exit opening 11 now slides in contact along the conical portion of the bobbin package 17, until contacting the lowest part of the tube 8 which is not covered by roving windings and reaches the end position a (FIG. 4*c*). During a subsequent vertical doffing movement p (FIG. 4*b*) of the bobbin package 17 on the spindle 14, the exit opening 11 is pressed by the spring 18 against a bare spindle ring or relatively short stub-shaped pin 22 (FIG. 4*d*), which has been freed by the doffed tube 15, immediately above the stop 16, i.e. in a position in which the exit opening 11 is bound to collide with the bottom part of the new empty tube to be donned. The exit opening 11 is thus placed into the immediate vicinity of the stop 16 for the bobbin tube bottom part. At the same time, the roving 3 is severed between the bobbin package 17 and the winding element 7, in a manner described in the following, to form a roving beard 20 outside the exit opening 11 the length of which, as described later on, can be chosen substantially as desired. As shown in FIG. 4*c*, the roving beard 20 is also located in the immediate vicinity of the bottom part 21 of the bobbin tube 8.

Figure 4D:
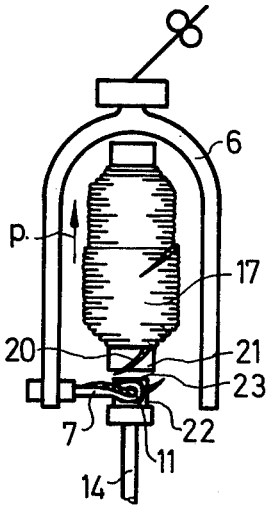

The bobbin package 17 is then doffed from the spindle 14 in a vertical direction by suitable means (not shown) e.g. manually or using an automatic doffing means. As shown in FIG. 4*d*, as the bobbin package 17 and the tube 15 are supported by the pin 22, a relatively short lift of the bobbin package 17 is sufficient to bring the bottom part 21 of the tube 15 to a position above the upper edge 23 of the pin 22. From this position, the bobbin package 17 can be taken off in any direction desired. If, however, the spindle 14 penetrates deeper into the tube (which arrangement can present better guiding possibilities for the tube), a correspondingly longer vertical movement of the bobbin package 17 is required. In order to avoid collisions of the bobbin package 17 with the flyer 6 in such arrangements, other known flyer constructions can be chosen, e.g. a closed flyer shape, the length of which corresponds to twice the length of the bobbin, or a pivotable arrangement, in which the flyer head is arranged to pivot laterally.

Figure 4E:
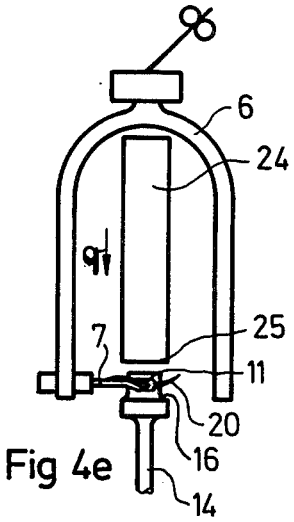

Referring to FIG. 4*e*, after doffing of the bobbin package 17 an empty tube 24 is donned in a vertical direction (arrow q) down to the stop 16 on the spindle 14, i.e. onto the pin 22 such that the tube 24 cannot slip on the pin 22. Suitable means for this are explained in more detail in the following.

Figure 4F:
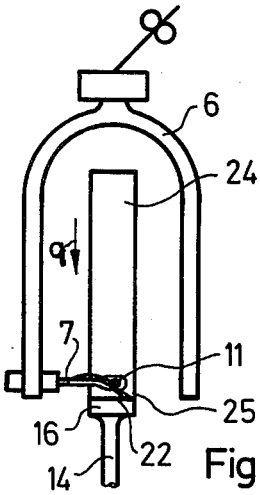

Due to the position of the exit opening 11, the roving beard 20 is brushed down as the empty tube 24 is donned and is then clamped (FIG. 4*f*) between the bottom part 25 of the tube 24 and the axial stop 16 of the spindle 14. During this time, the winding element 7 with the exit opening 11 is displaced radially outward by the outer rim of the bottom part 25 of the tube. This state is shown in FIG. 4*f*. The roving beard 20 is thus securely clamped and the working position of the roving frame is again ready for operation.

Figure 4G:
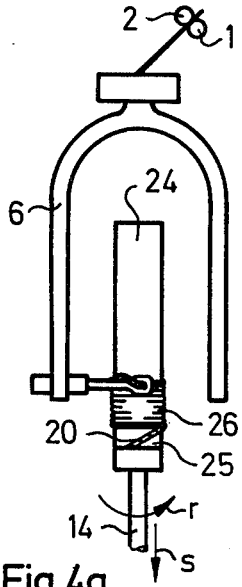

In FIG. 4*g* the working position of the roving frame is shown shortly after the subsequent start-up. The spindle 14 and the flyer 6 rotate (indicated by arrow r), the delivery rolls 1, 2 supply a roving and the spindle 14 performs a down traversing movement (indicated by arrow s). Roving windings 26 are formed, on the surface of the tube whereas the roving beard 20 now forms the connection between the bottom part 25 of the bobbin and the windings 26. The winding process can now proceed until the bobbin package build is completed (FIG. 4*a*). In this process, the formation of fly waste by ejected fibers is prevented due to the clamping of the roving beard 20. During the later doffing process of the completed bobbin package 17, the clamped roving beard 20 (FIG. 4*g*) is taken away upward together with the bobbin 17 in such a manner that no roving rests remain on the spindle 14. Thus, the cumbersome spindle cleaning operation required in the known roving transfer method is eliminated.

With reference to FIG. 5, a detailed description is given of the manner in which the roving 3 is severed by rolling on the bobbin surface. Due to the fact that the exit opening 11 of the winding element 7 is always pressed against the bobbin surface, even during a standstill, the roving extending over the exit opening 11 is rolled on the bobbin surface as the exit opening 11 is vertically shifted relative to the bobbin surface. Starting from the stop-off position A (FIG. 5) of the exit opening 11, the exit opening 11 can be moved vertically up (e.g. to the position B), or down (e.g. to the position C). According to the twist conditions prevailing in the roving, the twist generated by rolling the roving on the bobbin surface is superimposed on the roving twist in one of these shifting movements, whereas in the opposite shifting movement (e.g. down to the position C), the generated twist is subtracted.

In the first mentioned case, the roving extending beyond the exit opening 11*a* receives more twist and the roving strength is accordingly increased. In this case, the roving is severed, as necessitated by the increase of the roving path, outside this portion of the roving, i.e. in the zone of the roving deposited on the bobbin surface in which the twist is not increased, the roving strength there being lower, such that the fibers of the roving can glide apart. A roving beard 17 extending beyond the exit opening 11*a* of the winding device is thus formed. According to experience, this beard is at least twice as long as the longest fibers of the fiber material processed.

In the second case mentioned, the strengh of the roving in the portion immediately after the exit opening 11*b* is reduced as the exit opening 11 is shifted down to the position C in such a manner that the roving glides apart in this zone. A roving beard 29 which protrudes from the exit opening 11*b* is thus formed. According to experience, this beard is substantially of the same length of the longest fibers of the material processed.

Depending on the staple length of the material processed, the length of the roving beard can be chosen by choosing one or the other of the severing methods described above. This roving beard length is very important for the roving transfer. The roving beard length is always to be sufficient for reliable clamping of the roving beard 20 (FIGS. 4*a* through 4*g*) between the bottom part 25 of the tube and the axial stop 16. An upper limit of beard length, however, is not to be exceeded, as otherwise contamination problems due to fibers flying about could arise if the roving beard is not completely clamped.

Figure 6A:
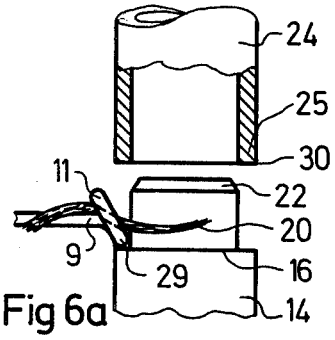

The process of roving beard clamping is described in more detail in the following:

In FIGS. 6*a* the situation prevailing shortly before the empty tube 24 is donned onto the spindle 14 in a vertical direction is shown. The extension 9 of the winding device 9 at the end containing the exit opening 11 is shaped as a small flat plate 29 arranged at an inclined angle to the spindle 14 and the room. This plate 29 contacts the ring 22 of the spindle 14 under the influence of the pressing means. The plate 29 may be of C-shape as shown in FIG. 10.

Figure 6B:
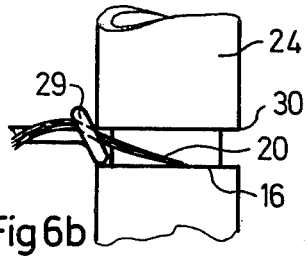
Figure 6C:
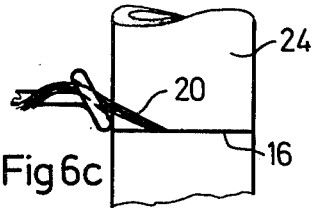

As shown in FIG. 6*b*, where the tube 24 is shown in an intermediate position, the roving beard 20 is brushed down by the bottom part 25 of the tube 24 while the exit opening 11 of the winding device, and the plate 29 respectively, is displaced toward the outside by the outer rim 30 of the empty tube 24. The inclined arrangement of the small flat plate 29 thus prevents any jamming danger of the winding device or of the small plate 29. In FIG. 6*c*, the tube 24 is shown in contact with the stop 16, i.e. the donning movement of the tube 24 is completed and the roving beard 20 is securely clamped.

Figure 7A:
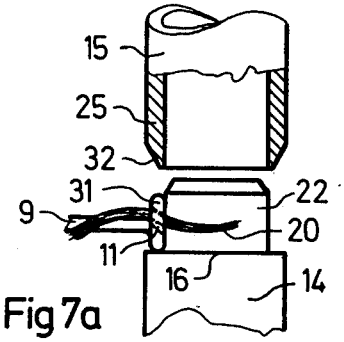
Figure 7B:
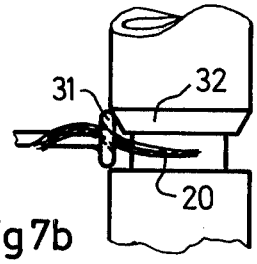
Figure 7C:
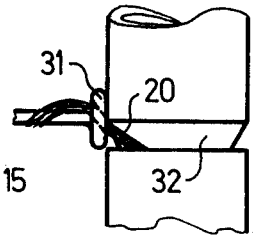
Figure 8:
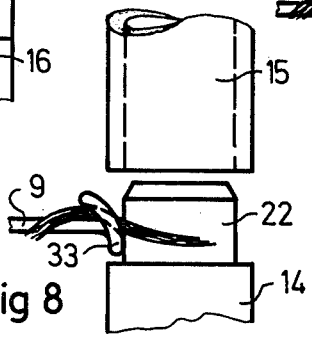
FIG. 8 illustrates a modified plate of a winding device according to the invention.

Referring to FIGS. 7*a*–7*c*, the winding device may alternatively be vertically disposed like the bottom part 25 of the tube is provided with a tapered-off zone 32. The tapered shape of the bottom part 25 of the tube is also used for preventing any jamming danger of the winding device, or of the small plate 31 respectively, between the bottom part 25 of the tube and the stop 16. For the same purpose of course, as shown in FIG. 8, a small plate 33 can be provided with is slightly curved outwardly in an upward vertical direction.

Figure 9:
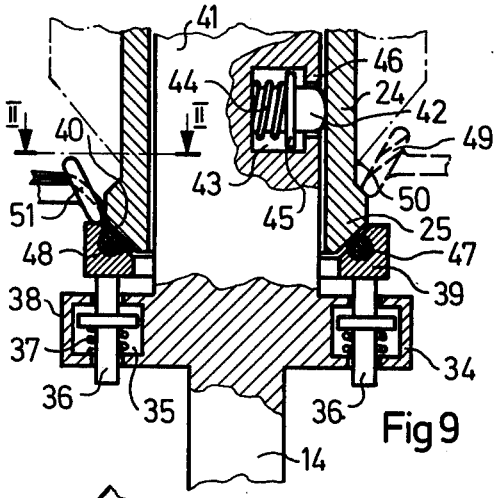
FIG. 9 illustrates a view of an axial stop and bobbin in accordance with the invention.
Figure 10:
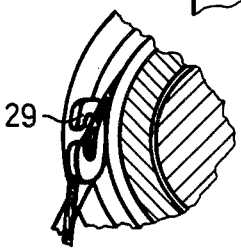
FIG. 10 illustrates a view taken on line II—II of FIG. 9.

Referring to FIGS. 9 and 10, the spindle can alternatively be provided with a ring-shaped neck 34 containing a plurality of chambers 35 distributed over the circumference. In each of these chambers 35, a vertical pin 36 is guided and, by means of a helical pressure spring 37 acting on a collar 38 of the pin 36, is pressed upward. The pins 36 in their upper parts support a ring 39 which forms the axial stop for the tube 24 and which can perform limited, vertical, resilient movements. As shown, the ring 39 has a conical annular surface facing inwardly. The tube 24 is provided with a conically tapered zone 40 at the bottom part 25 and is placed on the spindle shaft 41 to contact the conical surface of the ring 39.

In this arrangement, the roving beard is clamped between the bottom part 25 of the tube and the ring 39. For secure clamping of the roving beard and for ensuring slippage-free drive of the tube 24 by the spindle 14, the tube 24 is to be arranged on the spindle 14 in such a manner that positive rotational engagement is ensured. This can be achieved in a simple manner by the weight of the tube 24 itself (comp. FIGS. 1 through 8). If this proves insufficient, at least one presser member 42 can be provided in the spindle 14 which presses radially outwardly against the tube 24 to secure the tube 24 in the completely donned state against rotational slippage and/or in the axial direction.

As shown in FIG. 9, the presser member 42 is arranged in a recess 43 of the spindle shaft 41 and is pressed radially towards the outside by a pressure spring 44 in such a manner as to be pressed against the surface of the bore of the tube 24. The pressure member 24 is also provided with a retaining collar 45 which rests against a rim 46 of the opening of the recess 43 and thus prevents the presser member 42 from dropping from the recess 43. For centering purposes, evenly spaced distribution of more than one, e.g. of three, such presser members 42 along the circumference of the spindle shaft 41 is recommended.

A further possibility of ensuring secure clamping of the fiber beard and of preventing rotational slippage of the tube can be achieved by increasing the friction of the ring 39 in the zone in which the ring 39 contacts the bottom part 25 of the tube. In the arrangement shown in FIG. 9, a ring-shaped recess 47 is provided in the ring 39, which recess 47 receives a rubber ring 48 of fitting form. The conical zone 40 of the tube 25 thus contacts the surface of the rubber ring 48 in such a manner that the desired effect is advantageously achieved.

Due to the fact that the presser member 42 can also restrict the movement of the tube 24 in the axial direction, the tube 24 can be pushed down to be donned—overriding the upward force generated by the pressure springs 37—in such a manner that the ring 39 is displaced downward over a certain distance to be chosen. Thus, a determined area pressure is generated between the ring 39, or the rubber ring 48 respectively, and the bottom part 25 of the tube. Thus, the roving beard clamping action as well as the slippage-free engagement can be pre-set almost as desired. FIG. 10 shows the manner in which the roving beard is clamped. In this arrangement, the small plate 29 for the exit opening 11 of the winding device is formed as an inclined flat small plate which, in combination with the tapered zone 40 of the tube 24, ensures secure clamping of the roving beard.

The end position of the relative displacement of the winding device relative to the bobbin can be coordinated with the lowest winding point on the tube (the height position of the winding device indicated with broken lines in FIG. 9 at the right hand side coinciding with the lowest bobbin winding point 50). The end position, however, can also be chosen lower than the lowest bobbin winding point (as shown in FIG. 9 at the left hand side, the winding device being indicated with solid lines). In the first mentioned case, the winding device 7 is not required to be movable outside the maximum lift of the bobbin winding traverse; whereas, in the second mentioned case, the winding device is required to be lowerable outside this lift range. This more demanding construction can be particularly advantageous as far as the brushing down and the roving beard clamping action are concerned.

Notwithstanding the fact that in the context of the descriptions above, roving frames are described as being equipped with suspended flyers and with spindles to effect the traverse lift, the type of the flyer applied (open or closed flyer) as well as the system of traverse lifting activation, by the flyer or by the spindle, in principle is of no consequence. That is, the apparatus can be applied without difficulty to other types of flyers (e.g. to so called closed flyers which are supported at their upper and lower ends).

The invention thus provides a method and apparatus which provide for a secure clamping of the roving beard at the bottom part of the tube and, which ensure maintenance of the roving tension required during the bobbin exchange process. Furthermore, the roving transfer from the completed bobbin package to the empty tybe is effected without any waste generation in such a manner that cumbersome and difficult to eliminate roving rests do not remain on the spindle. Thus, optimum conditions are also created for automation of the bobbin exchange process such that the roving frame operation is freed to a large extent of the deficiencies of the operating personnel.

Furthermore, the roving beard is clamped neatly, i.e. completely such that the beard cannot dissolve during the subsequent operation, and thus cannot contaminate the air. The machine thus remains clean, the cleaning work required is reduced, and the working conditions for operation are substantially improved.

The method described herein is suitable for application on roving frames of any type and does not require complicated installations. The apparatus for implementing the method is of simple and economic construction and maintenance.

What is claimed is:

1. A method of transferring a fiber roving from a completed bobbin package to an empty tube on a spinning preparatory machine having a spindle, a flyer coaxial of the spindle and a winding device, said method comprising the steps of stopping the spindle supporting the bobbin package and the flyer in a position with the winding device located within the winding lift of the last winding of a roving on the bobbin package;

severing the roving between the bobbin package and the winding device to form a roving beard outside the winding device;

thereafter displacing the winding device relative to the bobbin package into an end position with the roving beard located in the immediate vicinity of the bottom part of the bobbin tube of the bobbin package;

doffing the bobbin package from the spindle in a vertical direction; and donning an empty tube onto the spindle in a vertical direction while brushing the roving beard downwardly to clamp the roving beard between the tube and the spindle.

2. A method as set forth in claim 1 wherein the said severing step includes rolling of the roving on the bobbin package surface to sever the roving.

3. A method as set forth in claim 1 wherein said severing step includes a vertical displacement of the bobbin package relative to the winding device.

4. A method as set forth in claim 3 wherein the relative displacement of the bobbin package is in a direction to cause rolling of the roving whereby the twist and the strength of the roving is reduced in a zone between the bobbin package and the winding device and the roving is pulled apart in said zone.

5. A method as set forth in claim 4 wherein said twist is reduced to zero-twist.

6. A method as set forth in claim 4 wherein the roving beard protruding from the winding device is substantially of the same length as the longest fibers of the fiber material being wound.

7. A method as set forth in claim 3 wherein the relative displacement of the bobbin package is in a direction to cause rolling of the roving whereby the twist and the strength of the roving is increased in a zone between the bobbin package and the winding device and the roving is pulled apart in a zone of the roving placed on the bobbin package surface in which no increased twist prevails.

8. A method as set forth in claim 7 wherein the beard protruding from the winding device is at least twice as long as the longest fibers of the fiber material being wound.

9. A method as set forth in claim 1 wherein said end position coincides with the lowest winding position on the bobbin tube.

10. A method as set forth in claim 1 wherein said end position is located below the lowest winding position on the bobbin tube.

* * * * *